US006830094B2

(12) United States Patent
Fink

(10) Patent No.: US 6,830,094 B2
(45) Date of Patent: Dec. 14, 2004

(54) DEVICE AND METHOD FOR PRODUCING METAL DIECAST PARTS, PARTICULARLY MADE OF NONFERROUS METALS

(75) Inventor: Roland Fink, Winterbach (DE)

(73) Assignee: Oskar Frech GmbH & Co., Schorndorf (DE)

( * ) Notice: Subject to any disclaimer, the term of this patent is extended or adjusted under 35 U.S.C. 154(b) by 0 days.

(21) Appl. No.: 09/984,970

(22) Filed: Oct. 31, 2001

(65) Prior Publication Data

US 2002/0056537 A1 May 16, 2002

(30) Foreign Application Priority Data

Oct. 31, 2000 (EP) ..... 00123367

(51) Int. Cl.[7] ..... B22D 17/04
(52) U.S. Cl. ..... 164/113; 164/316
(58) Field of Search ..... 164/113, 312, 164/316, 338.1

(56) References Cited

U.S. PATENT DOCUMENTS 3,452,805 A 7/1969 Morin ..... 164/155.6
3,520,026 A * 7/1970 Stidham et al. ..... 425/547
3,903,956 A 9/1975 Pekrol ..... 164/316
4,638,849 A * 1/1987 Whitehorn ..... 164/311
5,960,854 A * 10/1999 Fink et al. ..... 164/316

FOREIGN PATENT DOCUMENTS

DE 33 35 282 A1 9/1983 ..... B29F/1/03
DE 42 05 998 A1 2/1992 ..... B22D/17/30
JP 55-136554 * 10/1980 ..... B22D/17/02
JP 5-8017 * 1/1993 ..... B22D/35/00

OTHER PUBLICATIONS

European Search Report.

* cited by examiner

*Primary Examiner*—Kevin P. Kerns
(74) *Attorney, Agent, or Firm*—Crowell & Moring LLP

(57) ABSTRACT

A device for producing nonferrous metal diecast parts is described in which a hot-duct gate system is disposed in front of mold cavities, by means of which hot-duct gate system, it is possible to guide the hot molten metal closely in front of the mold cavities and to maintain it in the liquid condition until the next shot. As a result, solidified overflows or runner ducts and pressing residues are avoided. The new device can therefore operate in a very economical and precise manner.

32 Claims, 3 Drawing Sheets

DEVICE AND METHOD FOR PRODUCING METAL DIECAST PARTS, PARTICULARLY MADE OF NONFERROUS METALS

BACKGROUND AND SUMMARY OF THE INVENTION

This application claims the priority of German Patent Document 001 23 367.5, filed in Germany, Oct. 31, 2000, the disclosure of which is expressly incorporated by reference herein.

The invention relates to a device for producing metal diecast parts, particularly made of nonferrous metals, having a hot-chamber diecasting machine with an ascending duct constructed in a casting vessel and having a mouthpiece arranged in front of a gate system, as well as having a gate in front of a diecasting mold, the cross-section of the gate being adapted to the respective molten metal.

Hot-chamber diecasting machines are known which have a pertaining mold construction. During hot-chamber diecasting, the nonferrous metals zinc and magnesium and, to a lesser extent, lead or tin are cast. Metal has the characteristic of cooling rapidly. In order to achieve the best casting quality, diecasting therefore takes place at a high speed and at a high pressure. In this case, the mold filling operation takes between 5 ms and 30 ms (milliseconds) depending on the size of the parts and the minimal wall thickness. The closing force of the hot-chamber machines amounts to up to 10,000 kN.

In the case of the casting operation, certain experimental values exist for calculating the gate system which, for example, with respect to zinc, are at a maximal gate velocity of approximately 50 m per second and, with respect to magnesium, are at maximally 100 m per second. At the used high melting temperatures of approximately 650° C. in the case of magnesium and approximately 420° C. in the case of zinc, these nonferrous metals in the liquid condition are almost as liquid as water. In order not to exceed the above-mentioned gate velocity, the cross-section of the gate surface, that is, the portion of the gate system which afterwards permits the separation of the gate part from the mold, must have a correspondingly designed cross-section.

It is also known ("The Operation of the Diecasting Machine", Society of Die Casting Engineers, Detroit/USA, Copyright 1972, Page 7) that, in the hot-chamber diecasting method, a fan or a tangential gate is used in order to be able to uniformly fill the diecast part. Particularly when multiple molds are used, this leads to a complex gate system which, after the cooling of the metal, remains as a residue which cannot be used. This gate fraction, relative to the diecast part, has a weight fraction of between 40% and 100%. The gate fraction which remains after each shot is subsequently melted again which, however, requires considerable additional energy expenditures. In addition, material is lost because of melting loss, deburring of the gate system and its recycling.

It is an object of the present invention to provide, in the case of a device of the initially mentioned type, a further development in which significantly less gating fraction can be used.

For achieving this object, the invention, in the case of a device of the initially mentioned type, provides that the gate is part of a hot-duct gating system which provides a heating of the ducts and of the nozzles leading to the mold.

By means of this further development, it becomes possible to keep the material in the liquid condition in the always required partially very complex gate ducts, so that, after the cooling of the metal in the mold, no cooling occurs of the material situated in the gate ducts. This material can be used again during the next shot.

In the case of injection molding machines for plastic materials, it is basically known to use hot-duct systems. However, since the heat-conducting characteristics of plastic differ decisively from those of metals, an application of the design of such hot-duct systems, in the case of which the mold can be filled in a punctiform manner or by way of a tunnel, is not possible.

As a further development of preferred embodiments of the invention, it is provided that nozzle tips are fitted to the nozzles which are provided with a comb-type gate system or a fan-type gate system and directly adjoin the contour of the part, in which case the comb-type gate system or the fan-type gate system forms the gate or is disposed directly in front of the latter. This further development has the advantage that the molten metal situated in the gate cross-section of the nozzle tips, after the filling of the mold, changes at least into the semisolid condition, because the nozzle tips themselves are not heated. As a result this material prevents that, after the opening of mold, metal flows in out of the hot-duct system or flows through the latter back into the mouthpiece, the ascending duct or the casting vessel.

As a further development of preferred embodiments of the invention, the nozzle tips and the nozzles are in each case provided with conical plug connections which, also at the above-mentioned very high temperatures of from 650° C. and 420°, ensure a sufficient sealing-off by the placing of metal on metal.

In this case, the nozzle tips themselves can be fitted to heated nozzles and the nozzles, in turn, can be fitted to heated ducts.

As a further development of preferred embodiments of the invention, the nozzle tips can be constructed to be adapted to the respectively used mold of the part to be produced. In this case, the nozzle tips can be fitted laterally or centrally onto this mold.

An alternative for preventing the return flow of the liquid metal into the ascending line and the casting vessel can be achieved, according to certain preferred embodiments of the invention, in that a nozzle tip is assigned to the mouthpiece, which nozzle tip rests against the gate system, is unheated and in which a plug is formed after the filling of the mold, which plug, in turn, can prevent the return flow of the molten mass situated in the mouthpiece and the ascending tube back to the casting vessel. During the next shot, this plug is pressed into the hot-duct system, where a corresponding receiving space for the plug is provided in which the plug arrives and will thereby not further hinder the continued injection of liquid material. The plug will melt again in the hot-duct system.

In order to avoid a return flow into the casting vessel in every case, additionally to or instead of the above-mentioned alternative with a mouthpiece, it may also be provided, according to certain preferred embodiments of the invention, that a return valve is arranged in the ascending duct. A return valve may also be arranged in the casting plunger, so that the disadvantage which had previously occurred in the case of diecasting machines, which is when, during the withdrawal of the casting plunger from the ascending duct, there is no afterflow of material, as a result of the vacuum occurring in the casting cylinder, material flows past the plunger rings into the casting cylinder, can be avoided. As a result of the arrangement of a return valve in the casting plunger, material can now flow directly from the casting vessel through the casting plunger into the casting cylinder. The return valves which are to be used in this case should be comprised of a highly heat-resistant material or of ceramics in view of the occurring high temperatures.

Other objects, advantages and novel features of the present invention will become apparent from the following detailed description of the invention when considered in conjunction with the accompanying drawings.

DETAILED DESCRIPTION OF THE DRAWINGS

Figure 1:
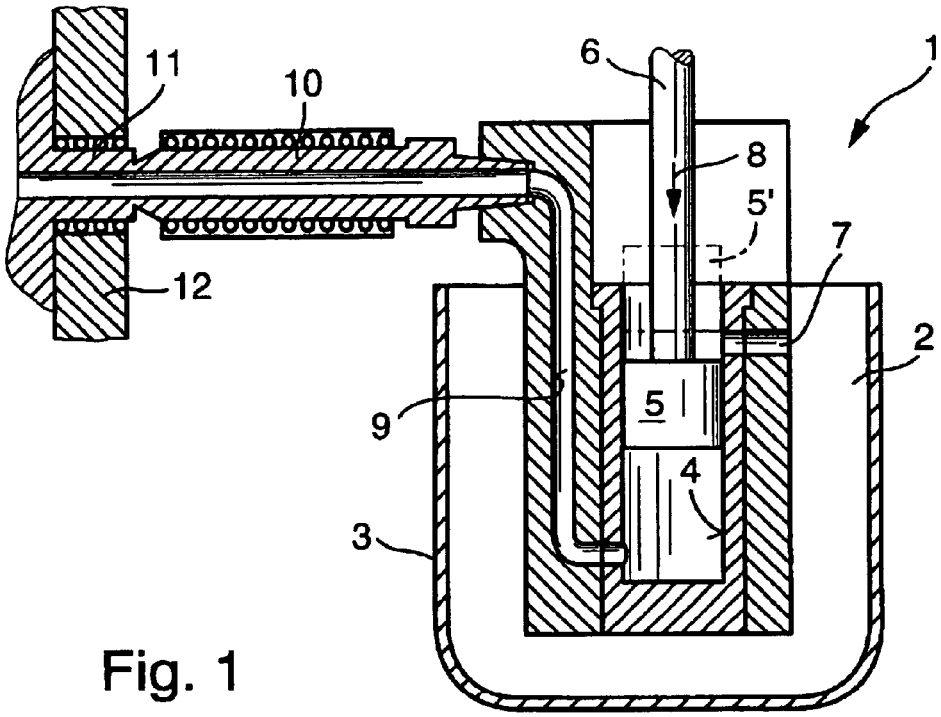
FIG. 1 is a schematic sectional representation of a casting unit of a hot-chamber diecasting machine with the mouthpiece fitted to the gate duct of a mold constructed according to preferred embodiments of the invention.

In a more or less schematic view, FIG. 1 first shows the casting vessel 1 of a hot-chamber diecasting machine which is placed in the molten mass 2 of the metal to be cast, such as magnesium or zinc. This molten metal 2 is held inside a crucible 3 which, in a manner not shown in detail, is placed in a holding furnace.

The casting vessel 1 has a casting cylinder 4 with a casting plunger 5 which in a manner not shown in detail because it is known is provided with a drive connecting to its plunger rod 6, which drive may be hydraulic or electric. In its upper area, the casting cylinder 4 has a lateral inflow opening 7 through which the molten mass 2 can flow into the interior of the casting cylinder 4 when the plunger 5 is situated in a position situated above this opening 7. In the illustrated condition, the casting plunger 5 has exceeded the filling position and is moved downward in the direction of the arrow 8, in which case the molten mass situated in the casting cylinder 4 and in the ascending bore 9 adjoining the casting cylinder 4 is fed by way of the heated nozzle 10 to the gate mouthpiece 11 which is situated in the schematically indicated fixed mold half 12.

While, in the case of conventional diecasting methods with hot-chamber diecasting machines, runner ducts lead out of the gate mouthpiece 11 in each case to the mold cavities and merge into these by way of gates, in the case of the device according to the invention, the gate mouthpiece 11 is part of a hot-duct gate system 13 which provides a heating of the runner ducts 14 and of the nozzles connected behind these, which heating extends to the mold cavity 16.

It is known that, in the case of conventional diecasting methods, the molten metal pressed by the casting plunger 5 through the ascending bore and through the mouthpiece nozzle 10, which arrives in the mold by way of the runner ducts and the respective gates, is pressurized until it solidifies. After the opening of the mold and possibly after the withdrawal of the cores, if these are part of the mold, the diecast part remains in the movable mold half, which is not shown here, while the casting plunger 5 moves back into its starting position which is indicated in FIG. 1 with 5' by a broken line. During this return movement, the molten mass situated in the nozzle mouthpiece 10 and in the ascending bore 9 is sucked back into the casting cylinder 4. The molten mass situated in the mold has solidified.

After the opening of the mold and the ejection of the parts, these must be deburred, which means that the gate, the runner ducts and the overflows must be separating from the diecast part. This entire casting residue will then be melted again and processed again. As indicated at the beginning, this requires relatively high labor and energy expenditures because—expressed in weight percent—this casting residue amounts to between 40 and 100% of the weight of the produced parts.

Figure 2:
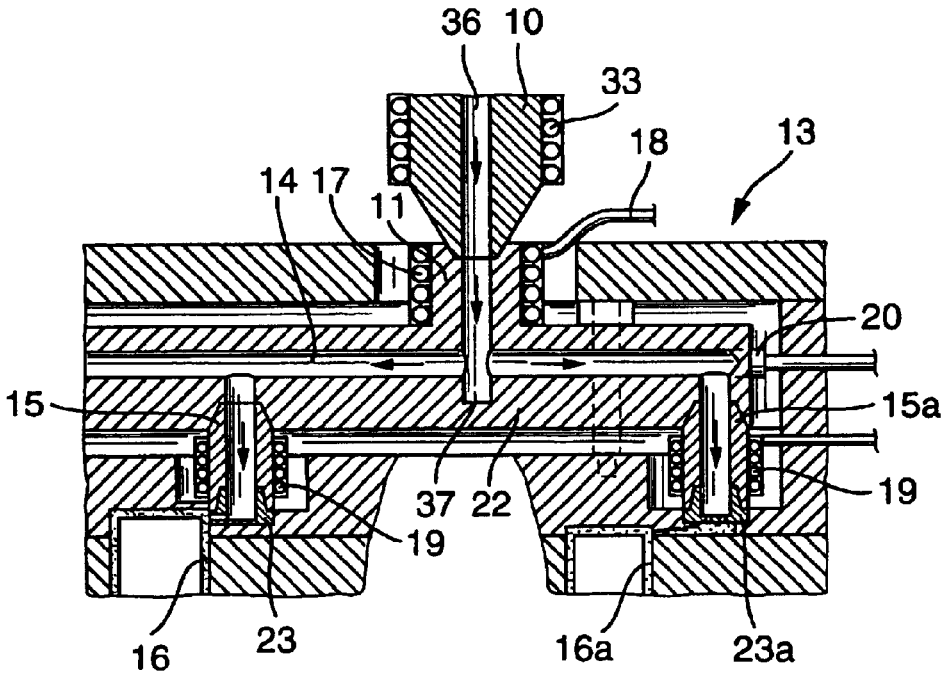
FIG. 2 is a schematic sectional representation of the hot-duct gating system provided according to the invention which leads into a mold.
Figure 3:
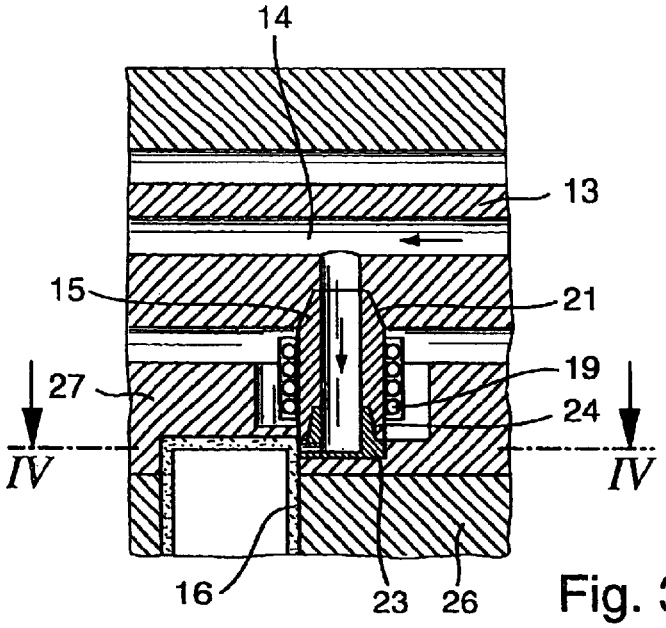
FIG. 3 is an enlarged sectional representation of the transition from the hot duct system into the mold according to the left-hand mold of FIG. 2.
Figure 4:
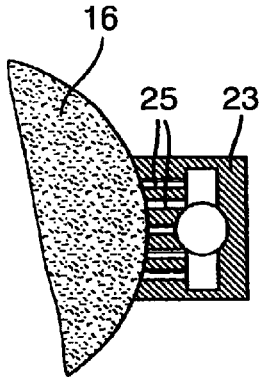
FIG. 4 is a schematic sectional representation of the nozzle tip of FIG. 3 used for the filling of the mold, as a sectional view approximately along Line IV—IV of FIG. 3.

The hot-duct system 13 according to FIG. 2 avoids the occurrence of such considerable casting residue. FIG. 2 first shows that the gate mouthpiece 11 is surrounded by a heating sleeve 17 which is supplied with energy by way of the connection line 18. Like the heating sleeves 19 and the heating cartridge 20 which are also to be provided and are used for heating the nozzles 15 and for heating the duct 14 respectively, the heating sleeve may be provided with electric current. FIGS. 2 and 3 show that the nozzle 15 in front of the mold cavity 16 is provided with a cone 21 and is fitted by means of the latter in the pertaining receiving cone of part 22 of the hot-duct system 13 and is held there in a sealed-off manner. In this manner, a metal-to-metal sealing is achieved which is desired at the high temperatures during the casting of nonferrous metals (650° C. in the case of magnesium and 420° C. in the case of zinc). A nozzle tip 23 is now inserted into these heated nozzles 15 at the end facing away from the cone 21, specifically also by means of a cone 24 which is tightly and firmly inserted into a corresponding countercone of the nozzle 15.

At its lower end, the nozzle 23 itself is equipped with injection ducts 25 which are arranged in a comb-shape and which lead directly into the mold cavity 16. As a whole, the cross-section of all injection ducts 25 should correspond to the gate cross-section which, according to the experimental values applicable to the hot-chamber diecasting method, is required for producing a certain mold. In this manner, it is ensured that the casting velocity occurring in these ducts 25 does not exceed the permissible maximal velocity, as mentioned above.

It can easily be seen that, in this case, the molten mass existing in the hot-duct system 13 can be maintained at a temperature at which it is still in the liquid condition. The molten mass which, after the termination of the diecasting operation, is maintained under pressure in the mold 16, solidifies relatively rapidly. The molten mass which is situated in the comb-type gate of the plurality of ducts 25 changes at least into the semisolid condition. As demonstrated, the nozzle tip 23 is not heated and is situated in the area of the mold cavity 16. This gate, which is formed by the plurality of ducts 25, during the removal of the movable mold half 26 is separated from the duct part 27 remaining at the fixed mold half 12, so that no solidified gate residue remains which subsequently would have to be melted again.

Figure 5:
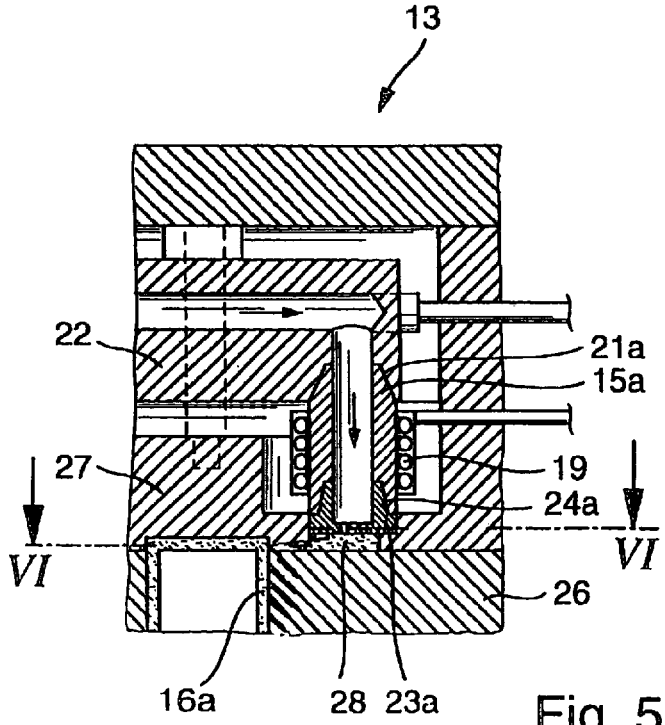
FIG. 5 is an enlarged sectional representation of the transition from the hot duct system to the mold corresponding to the right-hand mold in FIG. 2.
Figure 6:
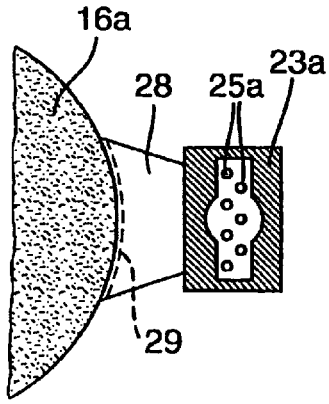
FIG. 6 is a sectional view of the nozzle tip and of the gate along Line VI—VI of FIG. 5.

A similar situation applies to the mold 16*a* which is schematically indicated as an additional example and which is connected by way of a gate fan 28 (FIG. 6) with a gate 29 which leads into the mold cavity 16*a* and has the nozzle 23*a*. FIG. 5 shows a nozzle 15*a* fitted with cone 21*a* as well as a cone 24*a* inserted into a corresponding counter cone of nozzle 15*a*. In the nozzle 23*a*, the gate ducts 25*a* are situated on the bottom of the nozzle in the nozzle and extend essentially in the direction of the axis of the nozzle 15*a*. During the casting, the gate fan 28 is therefore created below the nozzle 23*a*, which gate fan 28 changes by way of the gate 29 into the mold cavity 16*a*. During the separation of the movable mold half 26 from part 27 of the hot-duct gate system 13, the gate fan 28 is also ejected. By way of its gate 29, it can easily be separated from the finished part. The nozzle tips 23 and 23*a* of FIGS. 3 and 6 were in each case designed such that the gating takes place laterally on the nozzle.

Figure 7:
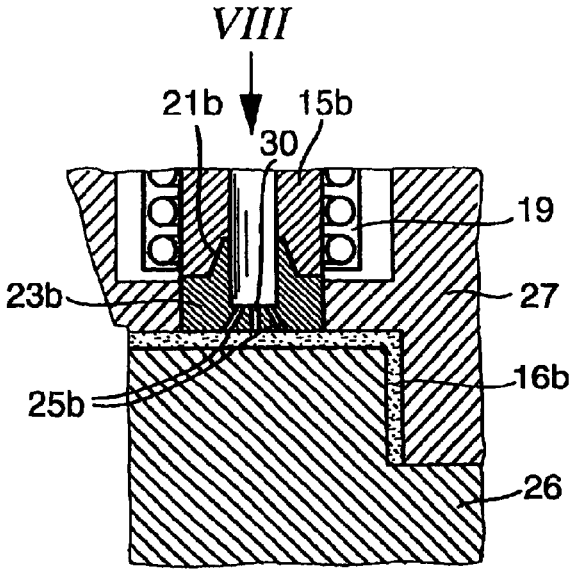
FIG. 7 is a representation similar to that of FIG. 3 or 5 but with a different arrangement of the transition of the molten mass to the mold.
Figure 8:
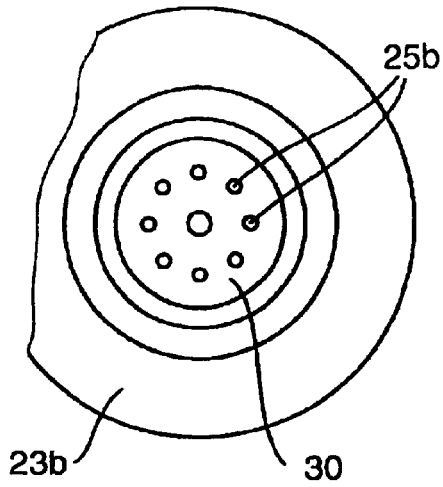
FIG. 8 is the schematic but enlarged view of the nozzle tip in the direction of the arrow VIII of FIG. 7 but without the nozzle connected in front.

FIGS. 7 and 8 now show another possibility of further developing a nozzle tip 23*b* which, in turn, is fitted by way of a cone 21*b* onto the nozzle 15*b*. By means of its gate ducts 25*b* and 30, this nozzle tip 23*b* is placed centrally on the mold cavity 16*b* and therefore has the effect that the molten mass is pressed centrally directly into the mold cavity 16*b*. As a result of the plurality of the ducts 25*b* or 30 also used here, which all—as in the case of the nozzle tips 23 and 23*a* of FIGS. 3 to 6—have diameters of approximately 1 mm to 1.5 mm, a type of comb-shaped gate is also created here which, during the opening of the mold, can easily be detached from the nozzle point as well as subsequently also from the diecast part.

For the purpose of an explanation, it should also be pointed out that the used nonferrous metals, such as magnesium and zinc, in the liquid condition, that is, therefore at their melting temperatures of approximately 650° C. in the case of magnesium and approximately 420° C. in the case of zinc, are as liquid as water. They can therefore easily be pressed into the corresponding mold cavities as a result of the "comb-type gate". The mold filling operation requires times which are in the order of between 5 ms and 30 ms. The material situated in the mold will then solidify relatively rapidly, while the material in the small bores 25, 25*a* and 25*b* of the nozzle tips 23, 23*a* and 23*b* will change into the semisolid phase and, as a result, also when the diecasting operation is terminated, will close off the hot-duct system 13. During the next shot, this material, which is still in the semisolid phase, will also be pressed into the mold.

When the hot-duct gating system 13 is used, attention should be paid to that fact that, during the withdrawal of the casting plunger 5, no liquid metal is withdrawn by way of the nozzle 10 and the ascending bore 9 from the hot-duct gating system 13. Should this be the case, the next shot could take place only with a certain time delay because the running ducts of the hot-duct gating system 13 and possibly also the ascending duct 9 and the mouthpiece 10 would first have to be filled again with molten mass.

Figure 9:
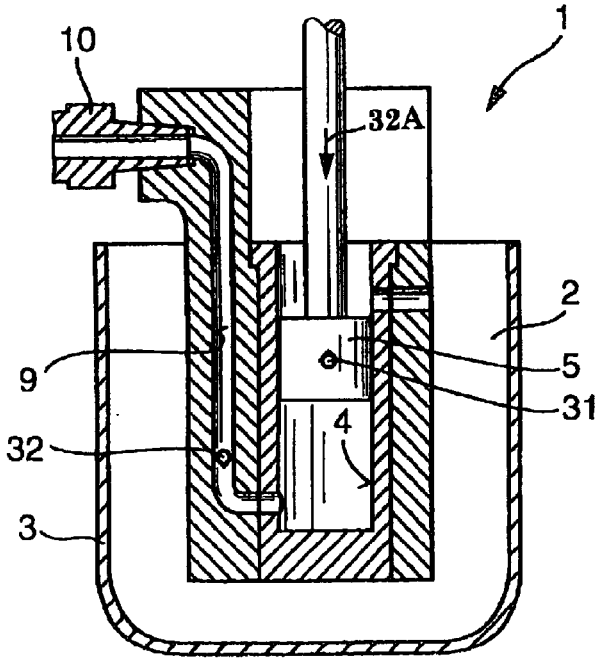
FIG. 9 is a partial view of the casting device of a hot-chamber diecasting machine similar to FIG. 1 but with return valves in the ascending bore and in the casting plunger, controlled according to another preferred embodiment of the present invention.

FIG. 9 therefore provides that the casting plunger 5 is equipped with a return valve 31 which makes it possible for the molten metal situated in the vessel 3 to flow, during the withdrawal movement of the casting plunger 5 in the direction of the arrow 32A from above through the casting plunger into the space of the casting cylinder 4 situated below it. A vacuum in the casting cylinder 4 during the return movement of the casting plunger, which occurs in conventional systems when the mouthpiece is closed off, does not occur here. In addition, another return valve 32 is inserted at the lower end of the ascending bore 9, so that here also no return flow of molten mass can take place as a result of the its weight. The liquid molten metal therefore remains in the hot-duct gating system 13, in the nozzle 10 and in the ascending duct until the next shot. Since, to this extent, the hot molten mass is present directly at the part or at the mold cavities 16, 16*a*, 16*b*, the casting process will be shorter and can therefore be controlled more precisely.

Figure 10:
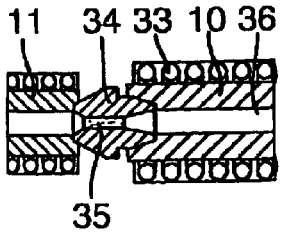
FIG. 10 finally is a schematic representation of the end of the mouthpiece with a fitted-on, not heated nozzle tip, constructed according to preferred embodiments of the invention.

FIG. 10 finally illustrates another possibility of preventing in a relatively simple manner the return flow of molten mass from the hot-duct gating system 13. Between the gate mouthpiece 11 of the hot-duct gating system 13 and the nozzle 10, which is heated in a known manner by an electric or inductively operating heating coil 33, a mouthpiece body 34 is inserted which is not heated and therefore forms a "freezing zone". After each shot, a cold plug 35 will be created inside this mouthpiece body 34 which seals off the passage bore of the nozzle 10. Molten mass in the heating duct system 13 can therefore not flow back through the gate mouthpiece 11.

FIG. 2 shows that the hot-duct gate system 13 has a receiving space 37 (FIG. 2) aligned with the passage opening 36 of the mouthpiece 10 on the runner duct 14, in which receiving space 37, the plug 35 is caught at the next shot and therefore cannot arrive through the duct system at the mold cavities. This plug will melt in the hot-duct system 13 before the subsequent shot.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Device for producing metal diecast parts made of nonferrous metals, having a hot-chamber diecasting machine with an ascending duct in a casting vessel and having a mold mouthpiece arranged in front of a gate system of a mold, and a gate in front of a diecasting mold cavity, a cross-section of the gate being configured to accommodate flow of a respective molten metal therethrough sufficient to permit mold fill between about 5 ms and about 30 ms when the molten metal is at a casting temperature of at least 400° C., wherein the gate is part of a heating-duct gate system which provides a heating of ducts and of nozzles opening to the mold cavity, wherein nozzle tips directly adjoining the mold cavity are fitted onto the nozzles, the nozzle tips having one of a comb-type and a fan-type gating system and the one of the comb-type and fan-type gating system forming the gate or being disposed directly in front of it, and wherein individual ducts of the nozzle tips are constructed to have such a small cross-section that molten metal situated therein changes into a semisolid condition after filling of the mold.

2. Device according to claim 1, wherein the nozzle tips and the nozzles are each equipped with conical plug connections for sealing-off thereof.

3. Device according to claim 1, wherein the nozzles are heated nozzles, and wherein the nozzle tips are fitted onto the heated nozzles, with the nozzles in turn being connected to heated ducts.

4. Device according to claim 1, wherein the nozzles are heated nozzles, and wherein the nozzle tips are fitted onto the heated nozzles with the nozzles in turn being connected to heated ducts.

5. Device according to claim 1, wherein the nozzle tips are configured to open into the mold cavity.

6. Device according to claim 5, wherein the nozzle tips are configured to be laterally or centrally fitted onto an assigned mold cavity.

7. Device according to claim 1, wherein a nozzle tip which rests against the gate system and is unheated is arranged at the mouthpiece of the hot-chamber diecasting machine, in which unheated nozzle tip, a plug is formed after the filling of the mold.

8. Device according to claim 7, wherein a receiving space is provided in the heating duct gate system for the plug, which plug is pressed out of the nozzle tip during a next subsequent molding shot.

9. Device according to claim 8, wherein the receiving space is arranged in alignment with a bore of the mouthpiece of the hot-chamber diecasting machine.

10. Device according to claim 1, wherein a return valve is arranged in the ascending duct.

11. Device according to claim 10, wherein the return valve is provided at a lower end of the ascending duct.

12. Device according to claim 11, wherein a return valve is arranged in a casting plunger disposed in the casting vessel and operable to force molten metal into the ascending bore.

13. Device according to claim 12, wherein the return valve consists of one of a highly heat-resistant metal and ceramics.

14. Device according to claim 11, wherein the return valve consists of one of a highly heat-resistant metal and ceramics.

15. Device according to claim 1, wherein a return valve is arranged in a casting plunger disposed in the casting vessel and operable to force molten metal into the ascending bore.

16. Device according to claim 15, wherein the return valve consists of one of a highly heat-resistant metal and ceramics.

17. A hot-chamber diecasting machine comprising:

a crucible for molten metal, a casting vessel disposable in the crucible and having an ascending duct accommodating flow of molten metal from the crucible, a mold forming a mold cavity and having an inlet mouthpiece, a nozzle mouthpiece connecting the ascending duct to the mold mouthpiece, a nozzle opening to the mold cavity, a gate system upstream of the nozzle opening to the mold cavity and downstream of the mold mouthpiece operable to communicate molten metal from the ascending duct to the nozzle and configured to permit mold fill between about 5 ms and about 30 ms when the molten metal is at a casting temperature of at least 400° C., and a heater operable to heat said gate system to minimize solidification of said molten metal in the gate system during operation of the diecasting machine to sequentially cast respective parts in said mold cavity, whereby metal in said gate system is usable for casting a subsequent part after cooling of a formed metal part and removal thereof from the mold cavity without requiring removal of cooled metal from the gate system wherein nozzle tips directly adjoining the mold cavity are fitted onto the nozzles, the nozzle tips having one of a comb-type and a fan-type gating system and the one of the comb-type and fan-type gating system forming the gate or being disposed directly in front of it, and wherein individual ducts of the nozzle tips are constructed to have such a small cross-section that the molten metal situated therein changes into a semisolid condition after filling of the mold.

18. A hot-chamber diecasting machine according to claim 17, wherein said heater is an electric wire heater with heated electric wires surrounding duct parts of the gate system located upstream of and adjacent said nozzle.

19. A hot-chamber diecasting machine according to claim 18, comprising a plurality of molds forming respective mold cavities, wherein the gate system includes a plurality of gates connected with respective nozzles opening to the respective molds.

20. A hot-chamber diecasting machine according to claim 17, comprising a plurality of molds forming respective mold cavities, wherein the gate system includes a plurality of gates connected with respective nozzles opening to the respective mold cavities.

21. A hot-chamber diecasting machine according to claim 17, wherein the nozzle tips and the nozzles are each equipped with conical plug connections for sealing-off thereof.

22. A hot-chamber diecasting machine according to claim 17, wherein the nozzles are heated nozzles, and wherein the nozzle tips are fitted onto the heated nozzles with the nozzles in turn being connected to heated ducts.

23. A hot-chamber diecasting machine according to claim 17, wherein a nozzle tip which rests against the gate system and is unheated is assigned to a mouthpiece of the hot-chamber diecasting machine, in which unheated nozzle tip, a plug is formed after filling of the mold cavities.

24. A hot-chamber diecasting machine according to claim 23, wherein a receiving space is provided in the gate system for the plug, which plug is pressed out of the nozzle tip during a next subsequent molding shot.

25. A hot-chamber diecasting machine according to claim 24, wherein the receiving space is arranged in alignment with a bore of the mouthpiece of the hot-chamber diecasting machine.

26. A hot-chamber diecasting machine according to claim 17, wherein a return valve is arranged in the ascending duct.

27. A hot-chamber diecasting machine according to claim 26, wherein the return valve is provided at a lower end of the ascending duct.

28. A hot-chamber diecasting machine according to claim 27, comprising a casting plunger operable to force molten metal from the crucible through the ascending duct during casting operations, and wherein a return valve is arranged in the casting plunger.

29. A hot-chamber diecasting machine according to claim 28, wherein the return valve consists of one of a highly heat-resistant metal and ceramics.

30. A hot-chamber diecasting machine according to claim 17, comprising a casting plunger operable to force molten metal from the crucible through the ascending duct during casting operations, and wherein a return valve is arranged in the casting plunger.

31. A method of making diecast parts with a hot-chamber diecasting machine which includes:

a crucible for molten metal, a casting vessel disposable in the crucible and having an ascending duct accommodating flow of molten metal from the crucible, a mold forming a mold cavity and having an inlet mouthpiece, a nozzle mouthpiece connecting the ascending duct to the mold mouthpiece, a nozzle opening to the mold cavity, and a gate system upstream of the nozzle opening to the mold cavity and downstream of the mold mouthpiece operable to communicate molten metal from the ascending duct to the nozzle and configured to permit mold fill between about 5 ms and about 30 ms when the molten metal is at a casting temperature of at least 400° C., wherein nozzle tips directly adjoining the mold cavity are fitted onto the nozzles, the nozzle tips having one of a comb-type and a fan-type gating system and the one of the comb-type and fan-type gating system forming the gate or being disposed directly in front of it, and individual ducts of the nozzle tips are constructed to have such a small cross-section that the molten metal situated therein changes into a semisolid condition after filling of the mold, said method comprising heating said gate system to minimize solidification of said molten metal in the gate system during operation of the diecasting machine to sequentially cast respective parts in said mold cavity, whereby metal in said gate system is usable for casting a subsequent part after cooling of a formed metal part and removal thereof from the mold cavity without requiring removal of cooled metal from the gate system.

32. A gate system for distributing molten metal, for a hot-chamber diecasting machine to respective molds forming respective mold cavities, comprising:

a plurality of gates leading in use to respective mold cavities, and a heater operable to heat said gate system to minimize solidification of said molten metal in the gate system during operation of the diecasting machine to sequentially cast respective parts in said respective mold cavities, whereby metal in said gate system is usable for casting a subsequent part after cooling of a formed metal part and removal thereof from the respective mold cavities without requiring removal of cooled metal from the gate system, wherein the plurality of gates are configured to permit respective mold fill between about 5 ms and about 30 ms when the molten metal is at a casting temperature of at least 400° C., wherein nozzle tips directly adjoining the mold cavity are fitted onto the nozzles, the nozzle tips having one of a comb-type and a fan-type gating system and the one of the comb-type and fan-type gating system forming the gate or being disposed directly in front of it, and individual ducts of the nozzle tips are constructed to have such a small cross-section that the molten metal situated therein changes into a semisolid condition after filling of the mold.

* * * * *